US006234197B1

(12) United States Patent
McKiernan et al.

(10) Patent No.: US 6,234,197 B1
(45) Date of Patent: May 22, 2001

(54) HOLDING TANK VACUUM RELIEF

(75) Inventors: Edward McKiernan, Big Prairie; James A. Sigler, Perrysville; William J. Friedman, Wooster, all of OH (US)

(73) Assignee: Sealand Technology, Inc., Big Prairie, OH (US)

( * ) Notice: Subject to any disclaimer, the term of this patent is extended or adjusted under 35 U.S.C. 154(b) by 356 days.

(21) Appl. No.: 08/717,904

(22) Filed: Sep. 23, 1996

(51) Int. Cl.[7] ..... F16K 17/04; B63B 29/14
(52) U.S. Cl. ..... 137/526; 4/321; 4/323
(58) Field of Search ..... 4/321, 323; 114/197; 137/454.2, 526, 538, 542, 543, 543.21, 557, 587

(56) References Cited

U.S. PATENT DOCUMENTS

| | | | | |
|---|---|---|---|---|
| 1,156,872 | * | 10/1915 | Atwood | 137/526 |
| 1,159,687 | * | 11/1915 | Kraft | 137/526 |
| 1,164,098 | * | 12/1915 | Kinsey, Jr. | 137/526 |
| 1,327,494 | * | 6/1920 | Sims | 137/526 |
| 1,336,280 | * | 4/1920 | Carroll | 137/526 |
| 3,542,057 | * | 11/1970 | Staiano | 137/542 |
| 3,587,116 | * | 6/1971 | Quase | 4/323 X |
| 4,324,007 | | 4/1982 | Morris | 4/323 X |
| 4,819,279 | | 4/1989 | Sigler et al. | 4/323 X |
| 4,941,503 | * | 7/1990 | Hubner, Jr. | 137/526 X |
| 5,139,655 | | 8/1992 | Sigler | 210/140 |
| 5,214,807 | * | 6/1993 | Terve | 4/323 X |

FOREIGN PATENT DOCUMENTS

| | | |
|---|---|---|
| 27426/71 | 10/1972 | (AU) . |
| 41 12 888 A1 | 10/1991 | (DE) . |
| 4 31 367 A1 | 3/1993 | (DE) . |

* cited by examiner

*Primary Examiner*—John Rivell
(74) *Attorney, Agent, or Firm*—Nixon & Vanderhye P.C.

(57) ABSTRACT

A plastic sewage holding tank in a boat, associated with a toilet, includes a vent check valve for providing vacuum relief. By mounting the vent check valve in the top of the tank, when the tank is being emptied by rapid pumpout implosion or other damage to the tank is prevented. The vent check valve may include a valve body with an interior surface mounting a quad sealing ring, with a valve element guided for reciprocal movement between a sealing position where an axially elongated substantially cylindrical peripheral surface of the valve element engages the quad ring, to an open position where the valve element is moved against spring bias away from the valve body. A spider, with a collar for guiding a shaft portion of the valve element, may mount a coil spring to provide a biasing action.

17 Claims, 6 Drawing Sheets

HOLDING TANK VACUUM RELIEF

BACKGROUND AND SUMMARY OF THE INVENTION

It has become increasingly common to provide sewage pumpout stations for boats at docks. In such installations, a pumpout pump is provided which is connected up to a sewage holding tank (typically of plastic) in the boat, and quickly pumps all of the sewage out of the tank. Most commercial pumps for these pumpout stations have a capacity of up 10 to about 40 gallons per minute (151 liters per minute), although capacities of as high as 170 liters per minute may be expected in the future. When such pumps are operated, it is difficult for the pump operator to know exactly when all the sewage has been pumped out of the holding tank, and the pump may stay in operation for a significant period of time, often up to about 30 seconds, after the tank has already been emptied. It has been recognized that this can exert a substantial strain on the holding tank, and can result in damage to the tank, or an implosion. Damage to the tank may result in leakage of sewage into the environment, obviously a highly undesirable event.

According to the present invention, an assembly is provided which solves the problem of possible holding tank damage as a result of rapid pumpout of the sewage from the tank at a dockside pumpout station. According to the present invention, vacuum relief is provided, typically in the form of a vent check valve, in the holding tank to prevent implosion or other damage to the tank associated with rapid pumpout through an outlet conduit and pumpout fitting. The vacuum relief means is capable of providing sufficient air flow into the holding tank so that if the holding tank is emptied by a 170 liter per minute pump remaining in operation for 30 seconds after the plastic holding tank has been emptied, no damage to the holding tank ensues.

The vent check valve utilized in the practice of the present invention preferably comprises a conventional vent check valve including a valve body, a reciprocal valve element, and a coil spring engaging the valve element and biasing the valve element so that it is in sealing relationship with the valve body. The coil spring has a spring constant sufficient to prevent the valve element from moving to an open position as a result of the boat hull being subjected to rough water.

The holding tank also typically includes an indicator of the fullness (e.g. at least an indicator of three-quarters fullness of the tank), and a gas vent, which typically is connected to a gas filter. Also, the tank outlet conduit can include in addition to a first branch which has a dockside pumpout fitting, a second branch connected to a pump within the boat, which in turn is connected to a seacock for discharge in open water where environmental regulations permit.

The vent check valve also typically provides means for guiding movement of the valve element with respect to the valve body from a sealing position engaging the valve body and preventing passage of fluid (ambient air) from outside the holding tank through the valve to inside the tank, to an open position allowing passage of fluid (air) from outside of the holding tank through the valve to inside the tank.

The valve body element may include an interior surface mounting a first sealing ring (such as a quad ring), and the valve element includes an axially elongated substantially cylindrical peripheral surface, the peripheral surface engaging the sealing ring in the sealing position. Typically the valve element includes a top and a bottom, with the peripheral surface extending between the top and the bottom. The top has a tapered peripheral edge portion of a smaller diameter than the cylindrical peripheral surface, and the bottom includes an annular ledge having a larger diameter than the substantially cylindrical peripheral surface, and for engaging the valve body to stop movement of the valve element, under the bias of the biasing means, in the sealing position.

The valve body may have an outer peripheral substantially cylindrical surface having at least one sealing ring (such as an O-ring, or a pair of O-rings) mounted thereby, and an external diameter. The holding tank comprises a top surface having a tubular element therein having an inner surface with an inner diameter slightly greater than the external diameter of the valve body outer peripheral surface. The valve body outer peripheral surface is disposed within the tubular element with the O-rings in sealing engaging the tubular element inner surface.

The means for guiding movement of the valve element preferably comprises: A shaft portion of the valve element substantially concentric with and extending upwardly away from the valve element substantially cylindrical peripheral surface. A spider disposed within the valve body interior surface, spaced from the second sealing ring. And, a collar connected to the spider, the collar receiving the shaft portion therein and guiding reciprocation of the shaft portion. Preferably the biasing means comprises: A coil spring having first and second ends thereof, and wherein the valve element further comprises a screw threaded end part of the shaft portion and a nut screw threaded thereon so that the position of the nut with respect to the valve element elongated peripheral cylindrical surface may be adjusted. And, wherein the coil spring first end engages the spider and the coil spring second end engages the nut, the coil spring being compressed between the nut and the spider.

The invention comprises both a boat assembly where the holding tank and other elements are mounted within the boat hull, and a sewage holding tank assembly per se which typically is used in a boat but may also be used in a recreational vehicle or the like.

It is a primary object of the present invention to provide a desirable holding tank assembly with vacuum relief, most desirably for use in a boat. This and other objects of the invention will become clear from an inspection of the detailed description of the invention and the appended claims.

DETAILED DESCRIPTION OF THE DRAWINGS

Figure 1:
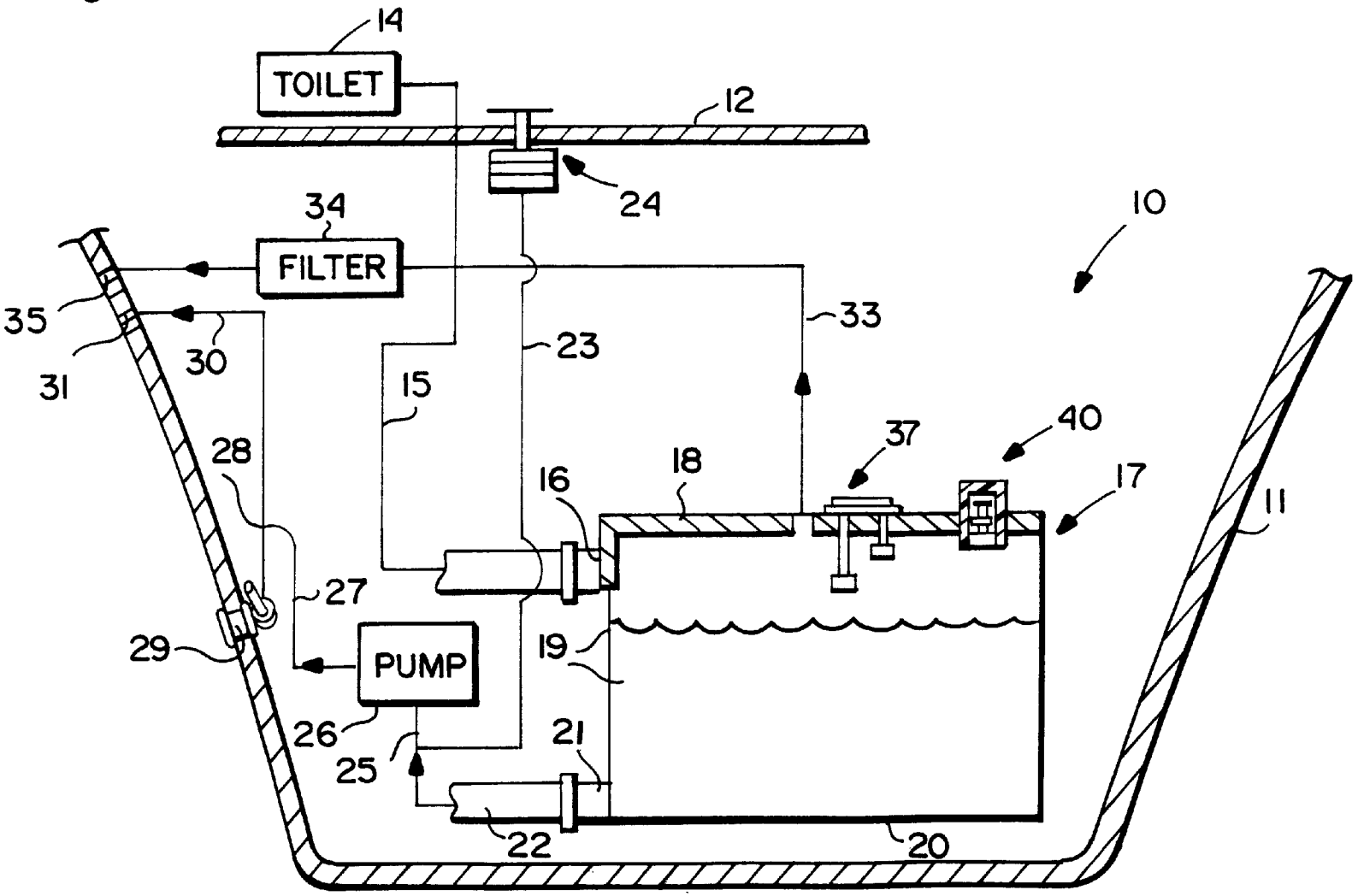
FIG. 1 is a schematic view, partly in cross-section, of a boat assembly according to the present invention.

A boat assembly according to the present invention is shown generally by reference numeral 10 in FIG. 1. It includes a boat hull 11 which defines an interior boat volume (perhaps with other structure such as a deck 12 and a super structure above the deck). A toilet 14 is mounted within the interior boat volume (e.g. on deck 12), and is connected by a hose 15 or the like to an inlet 16 to a plastic holding tank 17. The holding tank 17 has a top 18, closed side walls 19, and a bottom 20, and is also mounted within the interior boat volume (typically below the deck 12). The holding tank 17 has an outlet 21 which is connected to an outlet conduit 22. The outlet conduit 22 includes at least one branch 23 which is connected to a dockside pumpout fitting 24 (e.g. associated with deck 12). The outlet conduit 22 can also have a second branch 25 which is connected to a small pump 26 also mounted within the interior boat volume, which in turn is connected by a hose 27, typically having a vented loop 28, to a seacock 29. The vented loop 28 is vented as indicated by vent line 30 and vent opening 31 in hull 11.

As typically associated with a tank 17, a gas vent line 33 is preferably provided, which may have a filter 34 therein, and a vent opening 35 in the hull 11. Also an indicator 37 of the fullness of the tank 17 at at least one fullness level thereof, is provided. The indicator 37 may, for example, be a Tankwatch® level indicator sold by Sealand Technology, Inc. of Big Prairie, Ohio. The indicator 37 typically at least by indicates a three-quarters fullness level of the tank 17, and preferably also an approximately full level.

What has heretofore been described is conventional. What is provided according to the present invention in order to prevent an implosion of the tank 17, or other damage thereof, due to rapid pumpout through the outlet conduit 22 and dockside pumpout fitting 24, is the vacuum relief means 40. The vacuum relief means may comprise a structure that is good for only one use, such as a frangible element which will break at a lower force than the tank walls when the interior of the tank 17 is subjected to vacuum; or a simple flexible material (e.g. flapper valve) disposed inside the top 18 of the tank for releasably sealing a plurality of holes formed in the top 18; or a variety of other structures known per se to be responsive to vacuum. Preferably, however, the vacuum relief means 40 comprises a vent check valve, one embodiment of which is seen in each of FIGS. 1 through 3. The vacuum relief means 40 per se of FIGS. 1–3 is similar to a vent check used in the RV and mobile home industry, except that the biasing spring thereof is much stronger in order to prevent inadvertent opening due to rough seas, and provides a vacuum relief function rather than a venting function.

Figure 2:
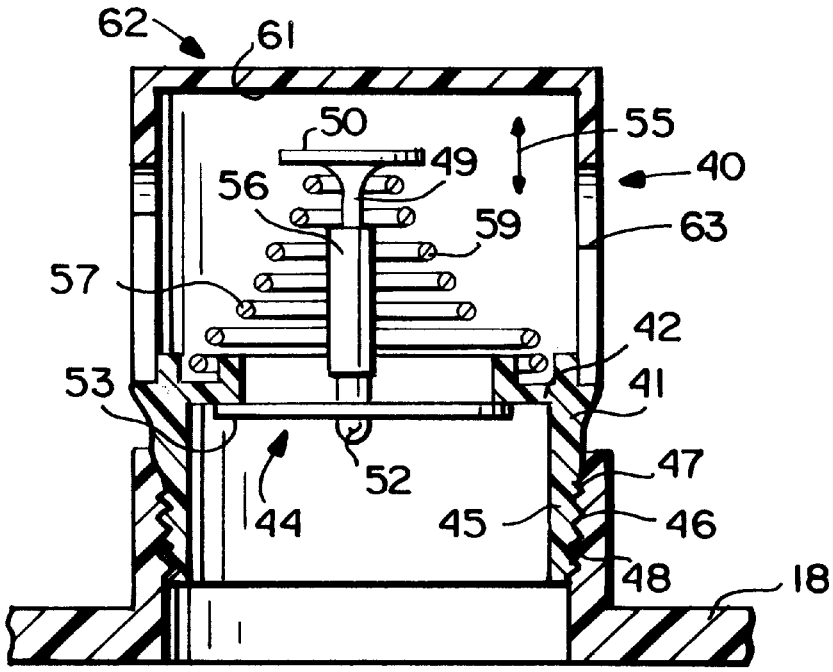
FIG. 2 is a side view, mostly in cross-section but partly in elevation, of a first embodiment of an exemplary vacuum relief means of the assembly of FIG. 1, showing a valve element biased to its closed position.
Figure 3:
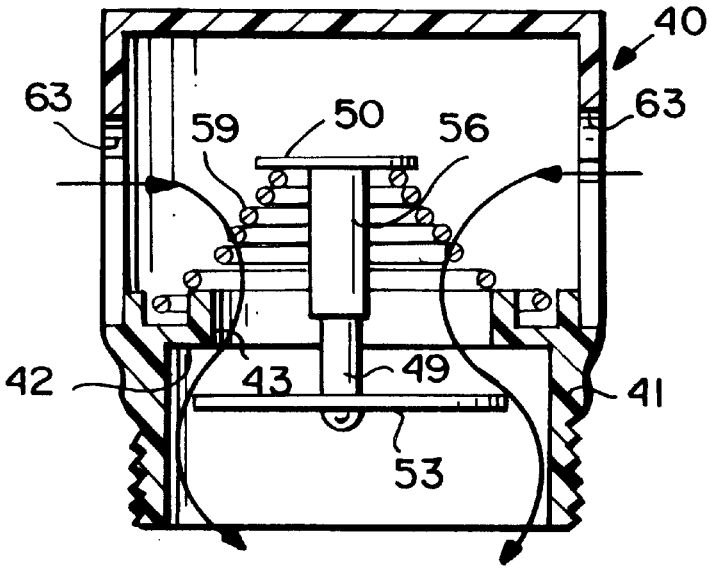
FIG. 3 is a view like that of FIG. 2 only showing the valve element moved to an open position to allow air to flow into the holding tank to prevent implosion or like damage.

As seen in FIG. 2, the vacuum relief means (vent check valve) 40 typically comprises a valve body 41 of ABS, or like plastic, including a ring shaped element 42 defining an interior circular opening 43 which cooperates with a movable valve element, shown generally by reference numeral 44. The bottom tubular portion 45 of the body 41 preferably has external threads 46 associated therewith which cooperate with internal threads 47 on a collar or fitting 48 upstanding from the top 18 (see FIG. 2) of the holding tank 17.

The movable valve element 44 preferably comprises a plastic pin 49 having a head 50 at one end thereof and connected at the other end 52 thereof to an elastomeric material (e.g. rubber) disc 53. The disc 53 has a diameter larger than the diameter of the opening 43, in the valve body 41, and when it engages the ring shaped portion 42 of the valve body 41 it seals the opening 43.

Guiding means are provided in the form of the valve pin 49 guided for reciprocating motion in the directions of arrows 55 (FIG. 2) by a guiding sleeve 56 mounted by spider arms 57 to the ring 42 of the valve body 41. Spring means, such as a conical coil spring 59, are provided for biasing the valve element 44 to the closed position illustrated in FIG. 2. Typically the coil spring 59 is mounted between the ring shaped portion 42 of the valve body 41 and the underside of the head 50 of the pin 49. Reciprocal movement of the pin 49 in the direction of the arrows 55 is stopped by the top of the sleeve 56, and by the inside top surface 61 of a valve cap 62, also of plastic and having at least two vent slots 63 formed therein to allow a sufficient volume of air to pass into the tank 17 to prevent implosion or like damage.

It is necessary that the spring constant of the spring 59 be great enough so that the disc 53 will be held tightly in sealing engagement with the ring 42 of the valve body 41 even when the hull 11 is subjected to rough water, otherwise sloshing sewage could exit the tank 17 through the vacuum relief 40.

FIG. 3 shows the vacuum relief means 40 in the position it will assume when the tank 17 is being evacuated by a dockside pump connected up to the fitting 24. Ambient air rushes through the slits 63 and the opening 43, past the elastomeric disc 53 into the interior of the tank 17. The opening 43, constant of the spring 59, and slit 63 must be dimensioned so that the tank 17 can be emptied with a 170 liter per minute positive displacement pump that remains in operation about 30 seconds after emptying the tank 17 without causing any structural damage to tank 17. Both the sewage, and in rushing air after the sewage has been pumped out, exit the tank 17 through the outlet conduit 22, and first branch 23 thereof, passing the fitting 24.

FIGS. 4 through 7 illustrate a second embodiment of a sewage holding tank 117, with a second embodiment of a vent check valve 140, according to the present invention. In FIGS. 4 through 7 structures comparable to those in FIGS. 1 through 3 are shown by the same reference numeral only preceded by "1".

Figure 4:
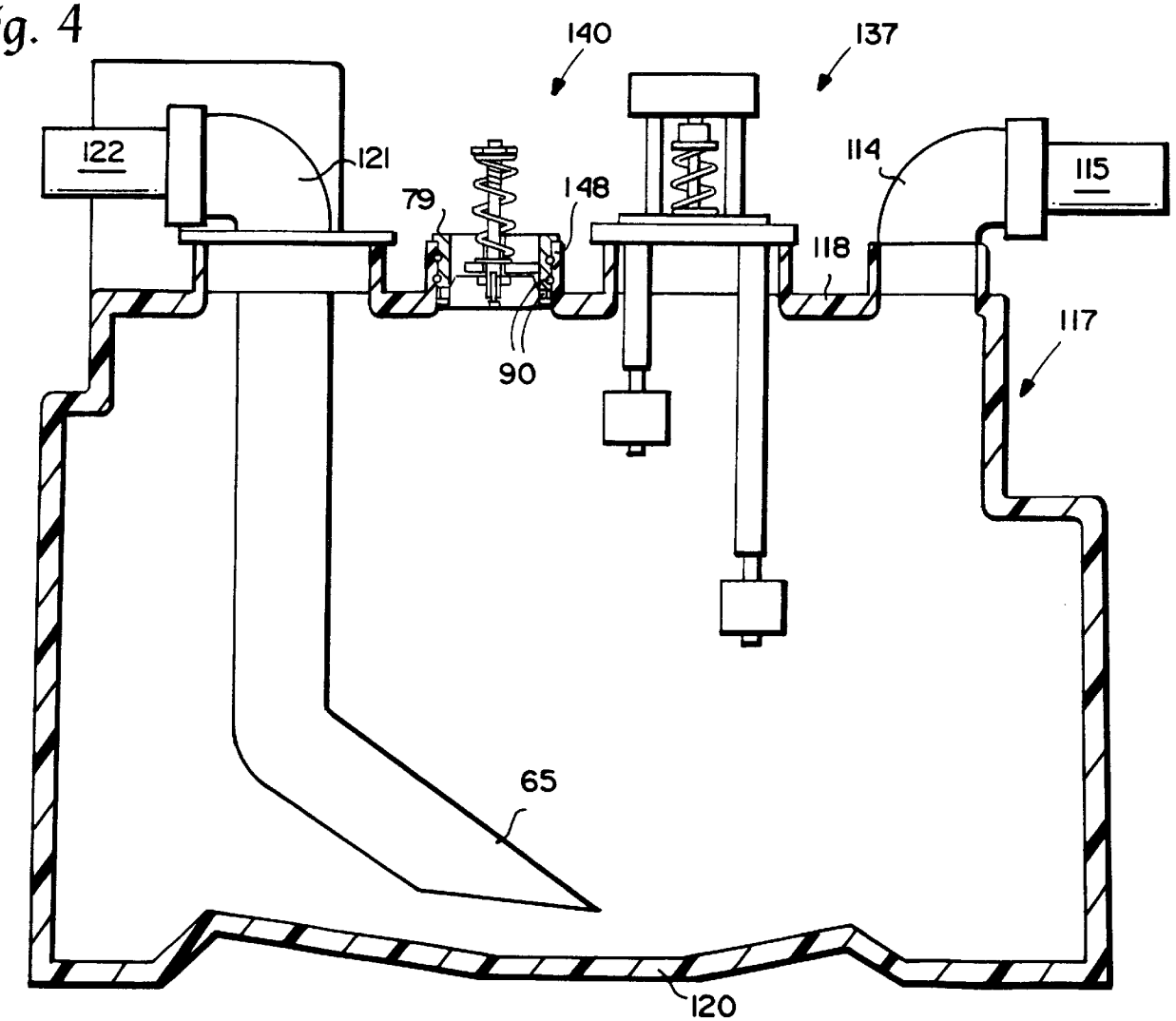
FIG. 4 is a side view, partly in cross-section and partly in elevation, of a second embodiment of a holding tank assembly according to the present invention.

In the FIG. 4 the plastic holding tank 117 is shown having a significantly different shape than the tank 17, and it has the outlet 121 and outlet conduit 122 at the top 118 thereof, rather than at the bottom, with a downwardly extending plastic pipe 65 with a substantially oval large opening at the bottom just above the tank bottom 120. The inlet 114 is also in the top 118 as is the tubular element 148 extending upwardly from the top surface 118 of the tank 117.

Figure 5:
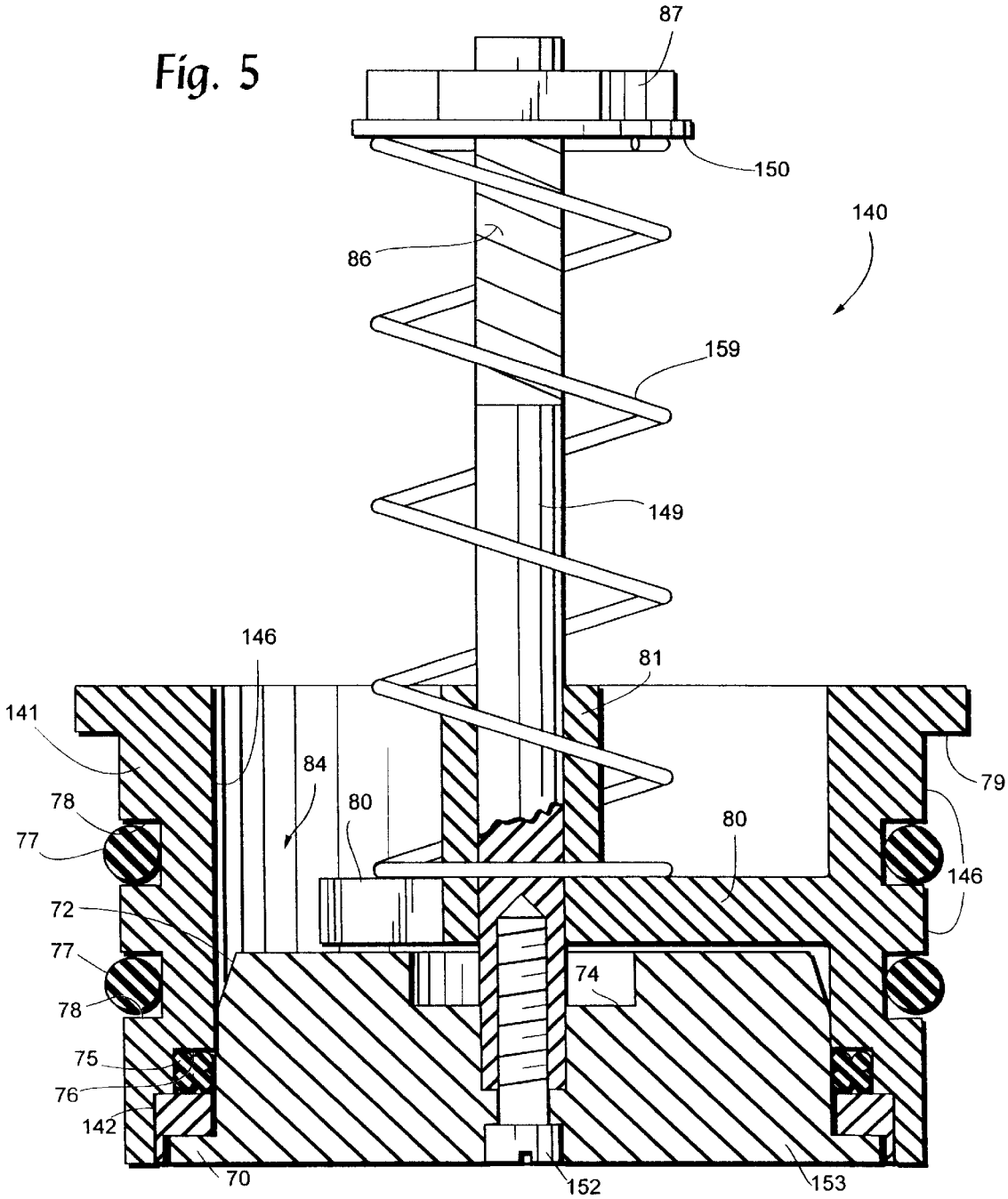
FIG. 5 is a side view, partly in cross-section (taken along lines 5—5 of FIG. 7) and partly in elevation, of the vent check valve in the embodiment of FIG. 4 showing the valve in the closed, sealing, position.
Figure 6:
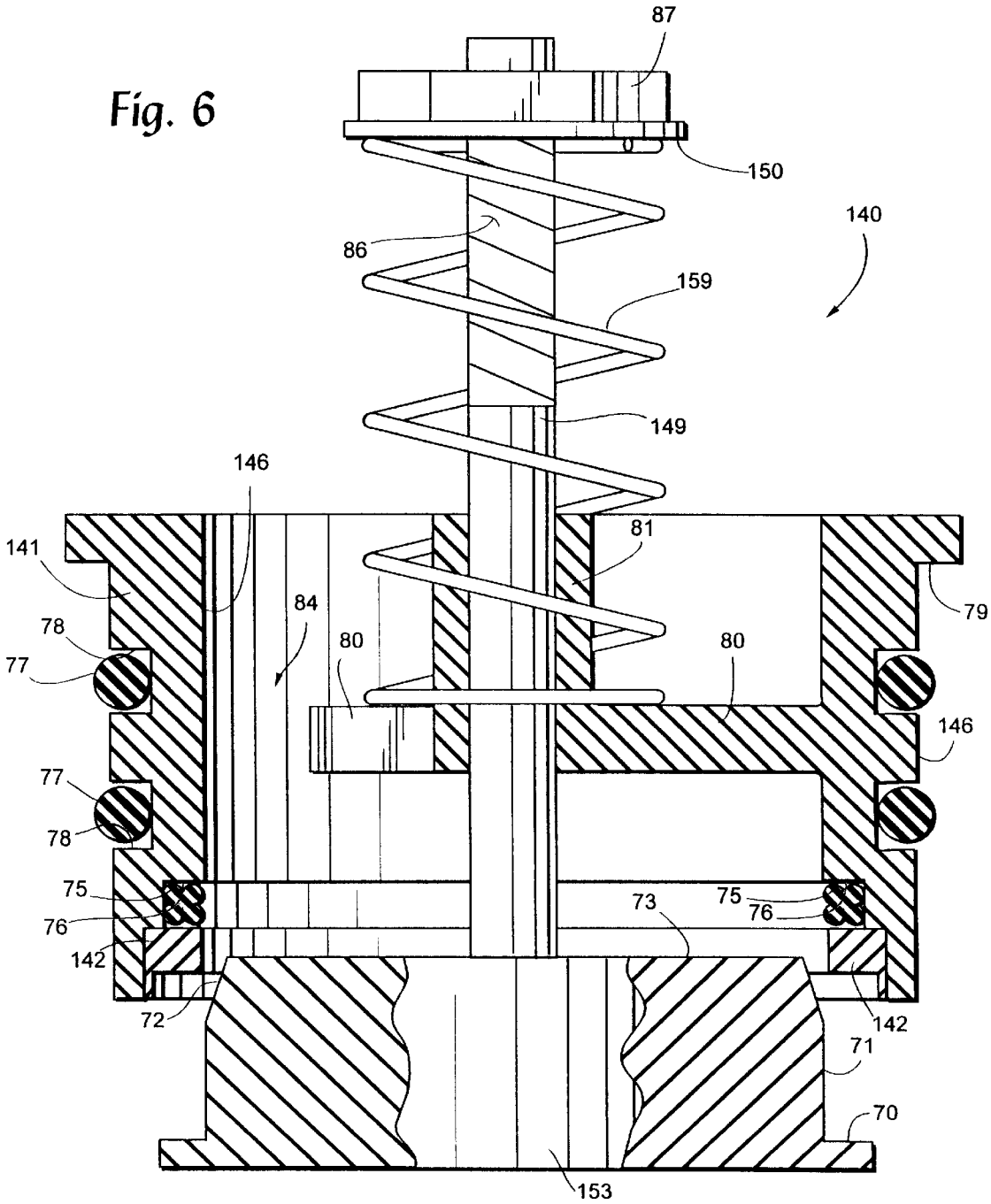
FIG. 6 is a view like that of FIG. 5 only showing the valve in the open position.
Figure 7:
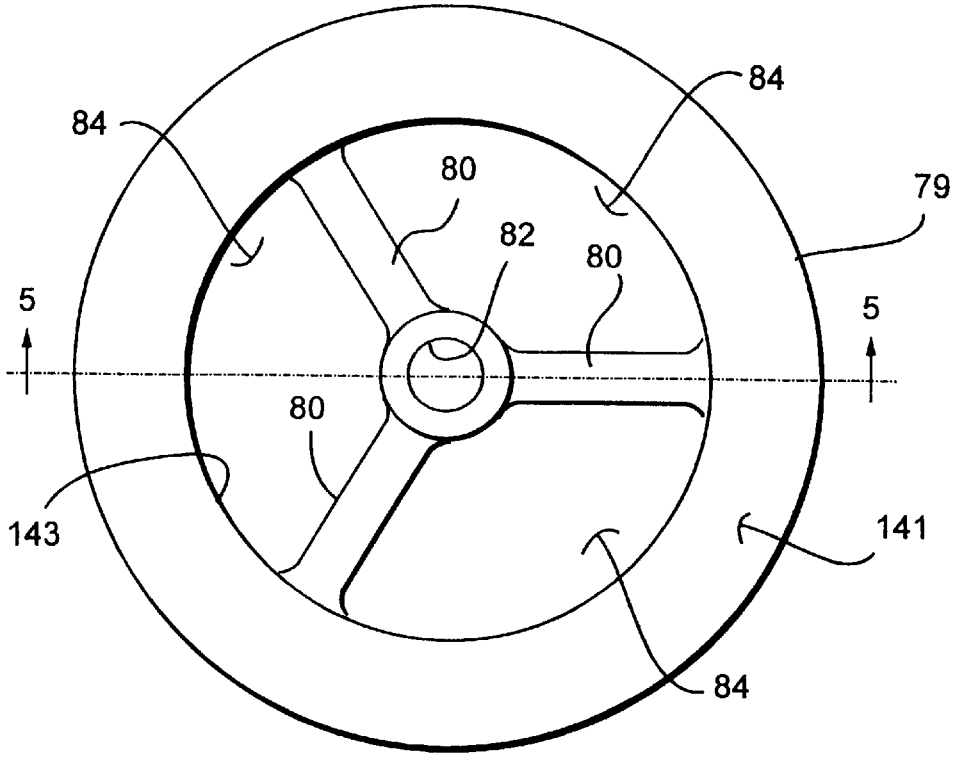
FIG. 7 is a top plan view of the valve body of the embodiment of FIGS. 5 and 6.

The valve element 153 includes a bottom flange 70 having a larger diameter than the substantially cylindrical elongated peripheral surface 71 portion thereof (see FIGS. 5 and 6). A tapered peripheral edge portion 72 of a smaller diameter than the surface 71 defining portion extends between the surface 71 and the top 73 of the valve element 153. The peripheral surface 71 cooperates, for sealing engagement, with a sealing ring, such as the quad ring 75 of elastomeric material (e.g. natural or synthetic rubber or a flexible plastic) which is seated in a channel 76 in the interior surface 143 of the valve body 141. A concentric depression 74 may be provided in the top 73 of the valve element 153, if desired, as illustrated in FIG. 5.

The tubular valve body 141 has a ring 142 adjacent the bottom thereof which mounts the quad sealing ring 75 in the channel 76. The valve body 141 also has an outer peripheral substantially cylindrical surface 146 having at least one sealing ring 77 mounted in a channel 78 therein. Preferably two axially spaced sealing rings 77 in channels 78 are provided as illustrated in FIGS. 5 and 6. The sealing rings 77 preferably are rubber or plastic O-rings as illustrated in FIGS. 5 and 6. The valve body 141 also has an upper largest diameter flange 79 which engages the top of the tubular element 148 as illustrated in FIG. 4. The surface 146 has a diameter slightly smaller than the interior diameter of the inner surface 90 (see FIG. 4) the tubular element 148, and the O-rings 77 (engaging the surface 90) and the flange 79 preclude gas from moving between the interior and exterior of the tank 117 between the element 148 and the valve body 141.

In the FIGS. 4 through 7 embodiment guided reciprocal movement of the valve element 153 between the sealing position of FIG. 5 and the open, air passing, position of FIG. 6 is provided by the shaft 149, spider 80 and collar 81. The shaft 149 extends substantially concentrically and upwardly from the valve element 153, and can be connected to the element 153 by a screw 152 (see FIG. 5) passing into an interior screw threaded opening within the shaft 149. The spider 80 has three or more arms as illustrated most clearly in FIG. 7, and preferably is integrally molded as part of the valve body 141. The axially extending, elongated, collar 81, having an interior diameter slightly greater than the exterior diameter of the shaft 149, also is preferably integral with the spider 80, as illustrated in FIGS. 5 and 6. The gas flow passages 84 are provided between the arms of the spider 80 and the interior surface 143 of the valve body 141.

On the upper end of the shaft 149 screw threading 86 is provided, which receives a nut 87 which can adjust position with respect to the screw threaded portion 86. The nut 87 abuts a washer 150. The substantially cylindrical coil compression spring 159 is compressed between the washer 150 and the top of the spider 80. While a coil compression spring is preferred, other spring biasing means such as leaf springs, blocks or tubes of elastomeric material, spiral springs, ring springs, volute springs, or Bellville springs, or the like, may be utilized.

The particular construction of the vent check valve 140 allows ready replacement in the top 118 of the tank 117 merely by pulling the valve body 141 upwardly, yet provides a positive seal due to the presence of the O-rings 77 and the flange 79. Also the particular construction of the valve element 153, the guiding means provided by the shaft 149, spider 80 and collar 81, and the particular construction of the valve body 141, are very simple, inexpensive, and reliable, and also may be readily easily replaced. Also this construction allows maximum ambient air flow into the tank 117 (through openings 84, past tapered edge 72) if a high vacuum condition exists in the tank 117.

In a typical assembly and operation of the vent check valve 140, first the valve body 141 is pressed into the tubular element 148 interior surface 90, sealing provided by the O-rings 77 and flange 79. The nut 87 is adjusted on the threaded shaft 86 to compress the coil spring 159 a desired amount so that the valve element 153 will open at a predetermined desired level of vacuum inside the tank 117. In normal usage the spring 159 pushes the flange 70 of the movable valve element 153 against the ring 142, and the passage of air between the interior surface 143 of the valve body 141 and the peripheral surface 71 of the valve element 153 is precluded by the seal at the quad sealing ring 75 which has a substantial positive sealing engagement with the surface 71, and by flange 70.

During pumpout of the tank 117, should all of the sewage be removed therefrom and the pump still operate, the vacuum condition inside the tank 117 will act on the large surface of the movable valve element 153, and pull it downwardly, against the bias of the spring 159, to the open position illustrated in FIG. 6. In this open position ambient can easily, freely, and in large volume flow from exteriorly of the tank through the open spaces 84 and between the surfaces 72, 71 of the valve element 153 and the interior of the valve body 141.

It will thus be seen that according to the present invention a simple yet effective vacuum relief mechanism is provided for a boat assembly 10, or holding tank assembly 17, 117, which will not compromise the integrity of the holding tank 17, 117 when the boat is subjected to rough seas, yet will prevent implosion or structural damage to the holding tank 17, 117 when it is rapidly pumped out at a dockside pumping station. While the invention has been herein shown and described in what is presently conceived to be the most practical and preferred embodiment thereof many modifications may be made thereof within the scope of the invention, which scope is to be accorded the broadest interpretation of the appended claims so as to encompass all equivalent structures and devices.

What is claimed is:

1. A boat assembly, comprising:

a boat hull defining an interior boat volume;

a toilet within the interior boat volume;

a sewage holding tank operatively connected to said toilet, and also within said interior boat volume, said tank capable of implosion or being permanently deformed if rapidly pumped out;

an outlet conduit from said holding tank, and including a dockside pumpout fitting;

an indicator of the fullness of said holding tank at at least one level of fullness thereof;

a gas vent from said holding tank; and means for providing vacuum relief for said holding tank to prevent implosion or other damage to said tank associated with said rapid pumpout of said tank through said outlet conduit and pumpout fitting comprising a vent check valve which comprises: a valve body; a movable valve element mounted interiorly of said valve body and said holding tank; means for guiding movement of said valve element with respect to said valve body from a sealing position engaging said valve body and preventing passage of fluid from outside said holding tank through said valve to inside said tank, to an open position allowing passage of fluid from outside of said holding tank through said valve to inside said tank; and spring means for biasing said valve element into said sealing position, in engagement with said valve body.

2. An assembly as recited in claim 1 wherein said valve body includes an interior surface mounting a first sealing ring; and wherein said valve element includes an axially elongated substantially cylindrical peripheral surface, said peripheral surface engaging said sealing ring in said sealing position.

3. An assembly as recited in claim 2 wherein said valve element includes a top and a bottom, said elongated substantially cylindrical peripheral surface extending between said top and said bottom; said top having a tapered peripheral edge portion of smaller diameter than said elongated substantially cylindrical peripheral surface, and said bottom including an annular ledge having a larger diameter than said elongated substantially cylindrical peripheral surface, and for engaging said valve body to stop movement of said valve element under the bias of said biasing means in said sealing position.

4. An assembly as recited in claim 2 wherein said first sealing ring comprises a quad ring.

5. An assembly as recited in claim 2 wherein said valve body has an outer peripheral substantially cylindrical surface having at least one second sealing ring mounted thereby and an external diameter; and wherein said holding tank comprises a top surface having a tubular element therein having an inner surface having an inner diameter slightly greater than said external diameter of said valve body outer peripheral substantially cylindrical surface; said valve body outer peripheral substantially cylindrical surface disposed within said tubular element, said valve body at least one second sealing ring sealingly engaging said tubular element inner surface.

6. An assembly as recited in claim 2 wherein said means for guiding movement of said valve element comprises: a shaft portion of said valve element substantially concentric with and extending upwardly away from said valve element substantially cylindrical peripheral surface; a spider disposed within said valve body interior surface, spaced from said second sealing ring; and a collar connected to said spider, said collar receiving said shaft portion therein and guiding reciprocation of said shaft portion.

7. An assembly as recited in claim 6 wherein said biasing means comprises a coil spring having first and second ends thereof, and wherein said valve element further comprises a screw threaded end part of said shaft portion and a nut screw threaded thereon so that the position of said nut with respect to said valve element elongated peripheral cylindrical surface may be adjusted; and wherein said coil spring first end engages said spider and said coil spring second end engages said nut, said coil spring being compressed between said nut and said spider.

8. An assembly as recited in claim 1 wherein said spring means exerts sufficient force to prevent said valve element from moving to said open position as a result of said hull being subjected to rough water.

9. An assembly as recited in claim 1 wherein said vacuum relief means is capable of providing sufficient airflow into said holding tank so that if said holding tank is emptied by a 170 liters/min. pump remaining in operation about 30 seconds after said holding tank has been emptied of sewage, no damage to said holding tank ensues.

10. An assembly as recited in claim 1 wherein said outlet conduit pumpout fitting is provided in a first branch of said outlet conduit, and wherein said outlet conduit further comprises a second branch; and further comprising a pump mounted within said interior boat volume and connected to said second branch, and a seacock operatively connected to said pump; and wherein said holding tank is made of plastic.

11. A sewage holding tank assembly comprising:

a plastic sewage holding tank having a top and a bottom, a hollow interior, and an exterior;

an outlet conduit from said holding tank and including a dockside pumpout fitting;

a vent for said holding tank, adjacent said top thereof for allowing passage of gas under pressure from said tank to the exterior thereof;

an inlet conduit for feeding sewage into said holding tank; and a vent check valve mounted to said holding tank top for allowing passage of air from exterior of said tank to the interior of said tank when a significant vacuum condition exists within said tank; and wherein said vent check valve comprises: a valve body; a movable valve element mounted interiorly of said valve body and said holding tank; means for guiding movement of said valve element with respect to said valve body from a sealing position engaging said valve body and preventing passage of fluid from outside said holding tank through said valve to inside said tank, to an open position allowing passage of fluid from outside of said holding tank through said valve to inside said tank; and spring means for biasing said valve element into said sealing position, in engagement with said valve body.

12. An assembly as recited in claim 11 wherein said valve body includes an interior surface mounting a first sealing ring; and wherein said valve element includes an axially elongated substantially cylindrical peripheral surface, said peripheral surface engaging said sealing ring in said sealing position.

13. An assembly as recited in claim 12 wherein said valve element includes a top and a bottom, said elongated substantially cylindrical peripheral surface extending between said top and said bottom; said top having a tapered peripheral edge portion of smaller diameter than said elongated substantially cylindrical peripheral surface, and said bottom including an annular ledge having a larger diameter than said elongated substantially cylindrical peripheral surface, and for engaging said valve body to stop movement of said valve element under the bias of said biasing means in said sealing position.

14. An assembly as recited in claim 12 wherein said valve body has an outer peripheral substantially cylindrical surface having at least one second sealing ring mounted thereby and an external diameter; and wherein said holding tank comprises a top surface having a tubular element therein having an inner surface having an inner diameter slightly greater than said external diameter of said valve body outer peripheral substantially cylindrical surface; said valve body outer peripheral substantially cylindrical surface disposed within said tubular element, said valve body at least one second sealing ring sealingly engaging said tubular element inner surface.

15. An assembly as recited in claim 14 wherein said means for guiding movement of said valve element comprises: a shaft portion of said valve element substantially concentric with and extending upwardly away from said valve element substantially cylindrical peripheral surface; a spider disposed within said valve body interior surface, spaced from said second sealing ring; and a collar connected to said spider, said collar receiving said shaft portion therein and guiding reciprocation of said shaft portion.

16. An assembly as recited in claim 15 wherein said spring biasing means comprises a coil spring having first and second ends thereof, and wherein said valve element further comprises a screw threaded end part of said shaft portion and a nut screw threaded thereon so that the position of said nut with respect to said valve element elongated peripheral cylindrical surface may be adjusted; and wherein said coil spring first end engages said spider and said coil spring second end engages said nut, said coil spring being compressed between said nut and said spider.

17. A sewage holding tank assembly as recited in claim 11 wherein said vent check valve is capable of providing sufficient airflow into said plastic holding tank so that if said plastic holding tank is emptied by a 170 liters/min. pump remaining in operation about 30 seconds after said holding tank has been emptied of sewage, no damage to said plastic holding tank ensues.

* * * * *